US005133265A

United States Patent [19]

Lahti et al.

[11] Patent Number: 5,133,265

[45] Date of Patent: Jul. 28, 1992

[54] VISUAL INDICATOR WITH ALIGNING RIDGES FOR INDICATING THE STATUS OF A CARRIAGE LOCK FOR A MOBILE STORAGE SYSTEM HAVING A ROTATABLE LOCK ACTUATOR KNOB

[75] Inventors: Richard Lahti, Fond du Lac; Kent Thomas, Mayville, both of Wis.

[73] Assignee: Tab Products Company, Palo Alto, Calif.

[21] Appl. No.: 681,922

[22] Filed: Apr. 8, 1991

[51] Int. Cl.[5] ..... B61C 9/00

[52] U.S. Cl. ..... 105/96; 105/101; 105/127; 188/31; 188/69; 70/210; 70/432; 292/359; 312/198

[58] Field of Search ..... 105/96, 101, 127; 188/31, 60, 69, 265; 70/207, 209, 210, 211, 212, 215, 216, 217, 432; 292/359, DIG. 27; 312/198, 200, 201

[56] References Cited

U.S. PATENT DOCUMENTS

| | | | |
|---|---|---|---|
| 943,471 | 12/1909 | Schoell | 70/432 X |
| 1,707,458 | 4/1929 | Clench | 188/31 X |
| 2,565,669 | 8/1951 | Smith | 70/432 X |
| 3,024,055 | 3/1962 | Novaino | 70/432 X |
| 3,357,546 | 12/1967 | Mathus | 70/432 X |
| 4,153,312 | 5/1979 | Taniwaki | 188/31 X |
| 4,262,507 | 4/1981 | Flack et al. | 70/432 |
| 4,523,794 | 6/1985 | Peterman | 70/210 X |
| 4,527,680 | 7/1985 | Sato | 70/209 X |

*Primary Examiner*—Matthew C. Graham

*Assistant Examiner*—S. Joseph Morano

*Attorney, Agent, or Firm*—Donald Cayen

[57] ABSTRACT

A mobile carriage is movable along rails by manual rotation of a handwheel. The mobile carriage comprises a visual indicator that instantly informs a person of the locked or unlocked status of the mobile carriage. The visual indicator comprises at least one ridge on the handwheel and another ridge on a locking knob. The locking knob is loosely captured between the handwheel and a hub for selective rotation relative thereto between first and second end positions. The locking knob has a cam that slides a pin within the hub between first and second positions whereat the pin disengages and engages a stationary lock plate. When the locking knob is manually rotated to the first end position thereof, the pin disengages from the lock plate to enable handwheel rotation and carriage movement. Manually rotating the locking knob to the second end position thereof causes the pin to engage the lock plate and prevent handwheel rotation and carriage movement. The ridges on the handwheel and locking knob are radially aligned when the locking knob is rotated to its first end position, indicating that the carriage is unlocked. The ridges on the handwheel and locking knob are radially misaligned when the locking knob is rotated to its second end position, indicating that the carriage is locked against movement. Closely spaced end surfaces on the two ridges are coated with a bright material to provide enhanced indication when the ridges are misaligned that the mobile carriage is locked against movement.

19 Claims, 3 Drawing Sheets

VISUAL INDICATOR WITH ALIGNING RIDGES FOR INDICATING THE STATUS OF A CARRIAGE LOCK FOR A MOBILE STORAGE SYSTEM HAVING A ROTATABLE LOCK ACTUATOR KNOB

BACKGROUND OF THE INVENTION

1. Field of the Invention

This invention pertains to locking devices, and more particularly to apparatus that visually indicates the status of a locking device.

2. Description of the Prior Art

In our co-pending U.S. Patent application Ser. No. 667,653 filed Mar. 11, 1991, we describe in detail the structural and operational features of a lock for a moveable carriage of a mobile storage system. The carriage lock is manually operable to selectively enable or prevent a moveable carriage from rolling along rails embedded in a building floor. When the carriage lock is operated to an unlocked status, a person can manually rotate a handwheel located on the end of the moveable carriage. The handwheel is fastened to a hub, which, in turn, is mounted for rotation about the longitudinal axis of a shaft that is fixed to the moveable carriage frame. The hub mates with and drives a driver sprocket also rotatably supported on the shaft. A chain trained over the driver sprocket transmits power from the handwheel, hub, and driver sprocket to the axles and wheels that support the moveable carriage on the rails.

Referring to FIG. 1, reference numeral 1 indicates a typical prior handwheel used to manually drive a moveable carriage along floor rails. To prevent rotation of the handwheel 1 and thus prevent rolling of the moveable carriage along the rails, the carriage lock includes a pin, such as is described in U.S. Patent application Ser. No. 667,653, that is slidable within the hub 9 in directions parallel to the handwheel longitudinal axis 11. The pin is slidable between a first position whereat it is disengaged from a lock plate stationarily held to a fixed shaft, and a second position whereat it is engaged with the lock plate. With the pin in engagement with the lock plate, rotation of the hub 9 and thus of the handwheel is prevented, and the carriage is therefore unable to move. When it is desired to move the carriage, the carriage lock is operated such that the pin slides within the hub to become disengaged from the lock plate.

To slide the pin within the hub 9 between being engaged with and disengaged from the lock plate, the carriage lock further includes a locking knob 5 that is rotatable about the longitudinal axis 11 relative to the handwheel 1 and hub 9. The handwheel is formed with a central opening 3 that receives the locking knob 5. A peripheral flange 6 on the locking knob 5 is rather loosely captured between the handwheel adjacent the opening 3 and a face 7 of the hub 9, thereby retaining the locking knob in place. The locking knob 5 has limited rotation relative to the handwheel 1 and hub 9 about the longitudinal axis 11 between first and second angularly spaced end positions.

The locking knob 5 is also formed with a cam that engages the head of the pin. A spring in the hub 9 biases the pin against the locking knob cam. By rotating the locking knob between its first and second end positions, the cam acts to slide the pin within the hub between the pin first and second positions, respectively.

To enable a person to easily rotate the locking knob 5 between its first and second end positions, the locking knob is formed with a diametrically extending ridge 13.

The person is able to grasp the ridge 13 with her fingers and thus rotate the locking knob without difficulty. In FIG. 1, it will be assumed that the solid lines 13 indicate the angular location of the ridge when the locking knob is in its first end position, and that the phantom lines 13, indicate the angular location of the ridge when the locking knob is in its second end position. Accordingly, the user of the mobile storage system is able to tell by looking at the position of the locking knob ridge relative to the handwheel 1 whether the mobile carriage is locked against movement or whether movement is permitted. Such knowledge of the status of the carriage lock is important to prevent a person from inadvertently attempting to force the handwheel 1 to move the moveable carriage when the handwheel is locked.

Although the prior carriage lock works very well, it nevertheless is subject to improvement. Specifically, it is considered desirable to enhance the visual indication given by the locking knob ridge 13 as to the status of the carriage lock.

SUMMARY OF THE INVENTION

In accordance with the present invention, a visual indicator is provided that enables a person to ascertain at a glance the status of the carriage lock of a mobile carriage. This is accomplished by apparatus that includes a set of cooperating ridges formed on the carriage lock and on a handwheel that manually drives the mobile carriage.

The handwheel is fastened to a hub that is rotatably mounted to a shaft fixed to the mobile carriage. The hub mates with a drive mechanism connected to carriage wheels. By manually rotating the handwheels the carriage is rolled along floor mounted rails, as is known in the art.

The carriage lock comprises a lock plate held stationarily to the shaft. The periphery of the lock plate is formed with teeth. A pin is slidable within the hub between a first position whereat the pin is disengaged from the lock plate teeth and a second position whereat the pin is engaged with the lock plate teeth. When the pin is engaged with the lock plate, rotation of the hub and handwheel is prevented, and the carriage is locked against movement. Hub and handwheel rotation is permitted when the pin is in the first position thereof.

To slide the pin between the first and second positions thereof, a locking knob is captured between the hub and handwheel for rotation relative to them. Locking knob rotation relative to the hub and handwheel is about an axis concentric with the axis of rotation of the handwheel and hub. Locking knob rotation is limited by the cooperation of a cutout in the locking knob and a pin in the hub such that the locking knob is rotatable between first and second angularly spaced end positions. The locking knob is generally disk shaped, and it has an outer periphery. On one face of the disk is formed a cam designed to contact the pin. The cam slides the pin between the first and second positions thereof in response to rotation of the locking knob between its first and second end positions, respectively.

The second face of the locking knob protrudes through a bore in the handwheel. The ridges of the carriage lock are formed on the locking knob disk second face, and they are readily visible to users of the mobile carriage. Preferably, the ridges extend radially from the locking knob axis of rotation and terminate at respective outer end surfaces at the locking knob outer periphery. The handwheel ridges have respective inner end surfaces at the handwheel bore, and the handwheel ridges radiate from the handwheel axis of rotation. The locking knob ridges are radially aligned with associated handwheel ridges when the locking knob is in the first end position thereof. The facing end surfaces of the handwheel and locking knob ridges are then rather close to each other. The locking knob and handwheel ridges are misaligned when the locking knob is in the second end position thereof, and the outer surfaces of the locking knob ridges and the inner surfaces of the handwheel ridges are displaced from each other. A person is thus able to immediately ascertain the status of the carriage lock by the aligned or misaligned nature of the locking knob and handwheel ridges.

To provide an even more apparent visual indication of the status of the carriage lock, the outer end surfaces of the locking knob ridges can be covered with a bright colored material. Alternately, the inner end surfaces of the handwheel ridges can be coated with the bright material. If desired, the facing end surfaces of both ridges can be colored. Because the facing end surfaces of the handwheel and locking knob ridges are close to each other when the locking knob is in the first end position thereof, the colored areas are then not easily visible. On the other hand, when the locking knob is rotated to the second end position thereof, the facing end surfaces of both ridges are completely exposed and very readily seen. The colored surfaces thus give an additional indication above that given by the misalignment of the handwheel and locking knob ridges that the mobile carriage is locked against movement.

Other advantages, benefits, and features of the invention will become apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 2:
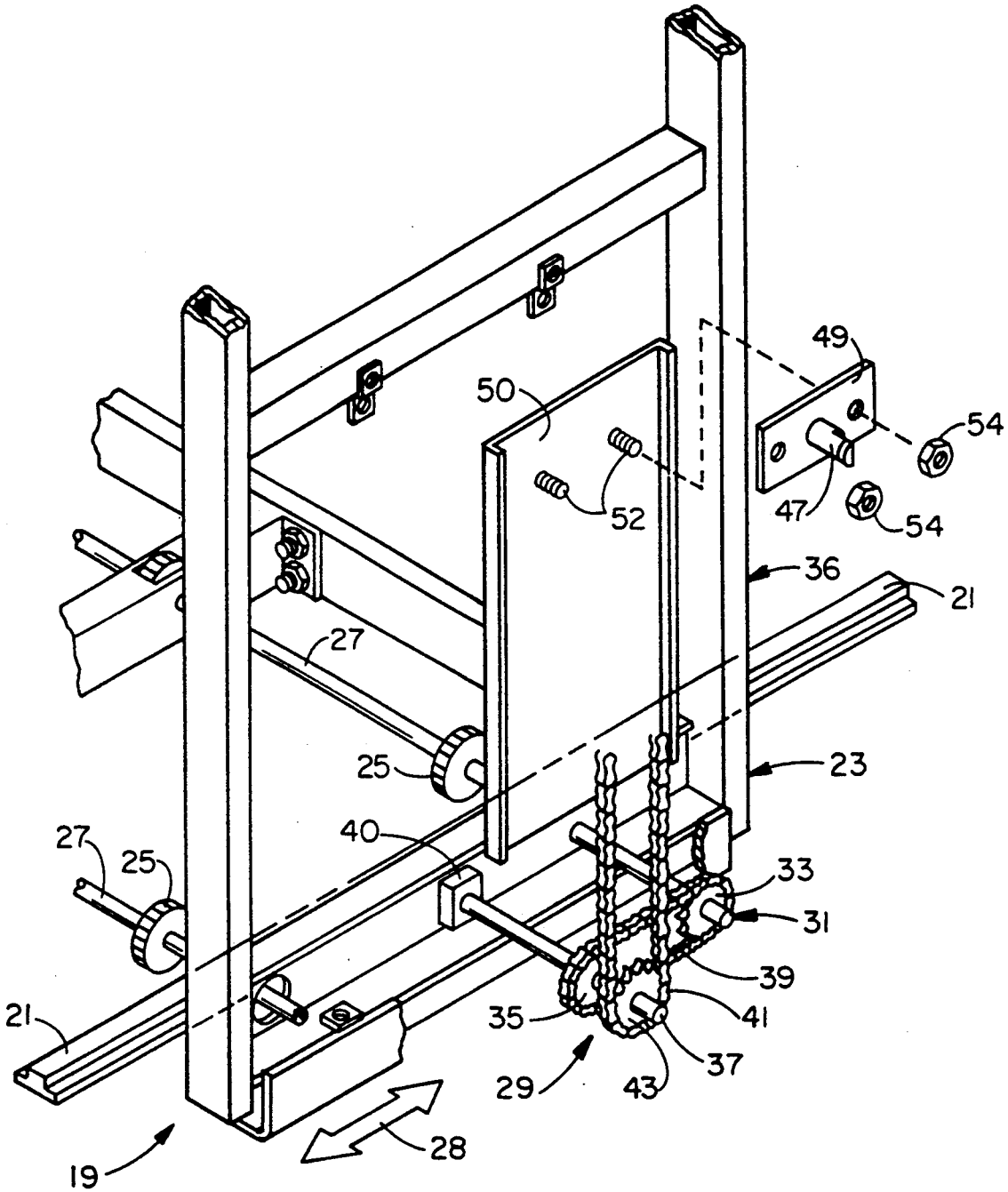
FIG. 2 is an exploded perspective view of a portion of a mobile storage system with which the present invention is advantageously used.
Figure 3:
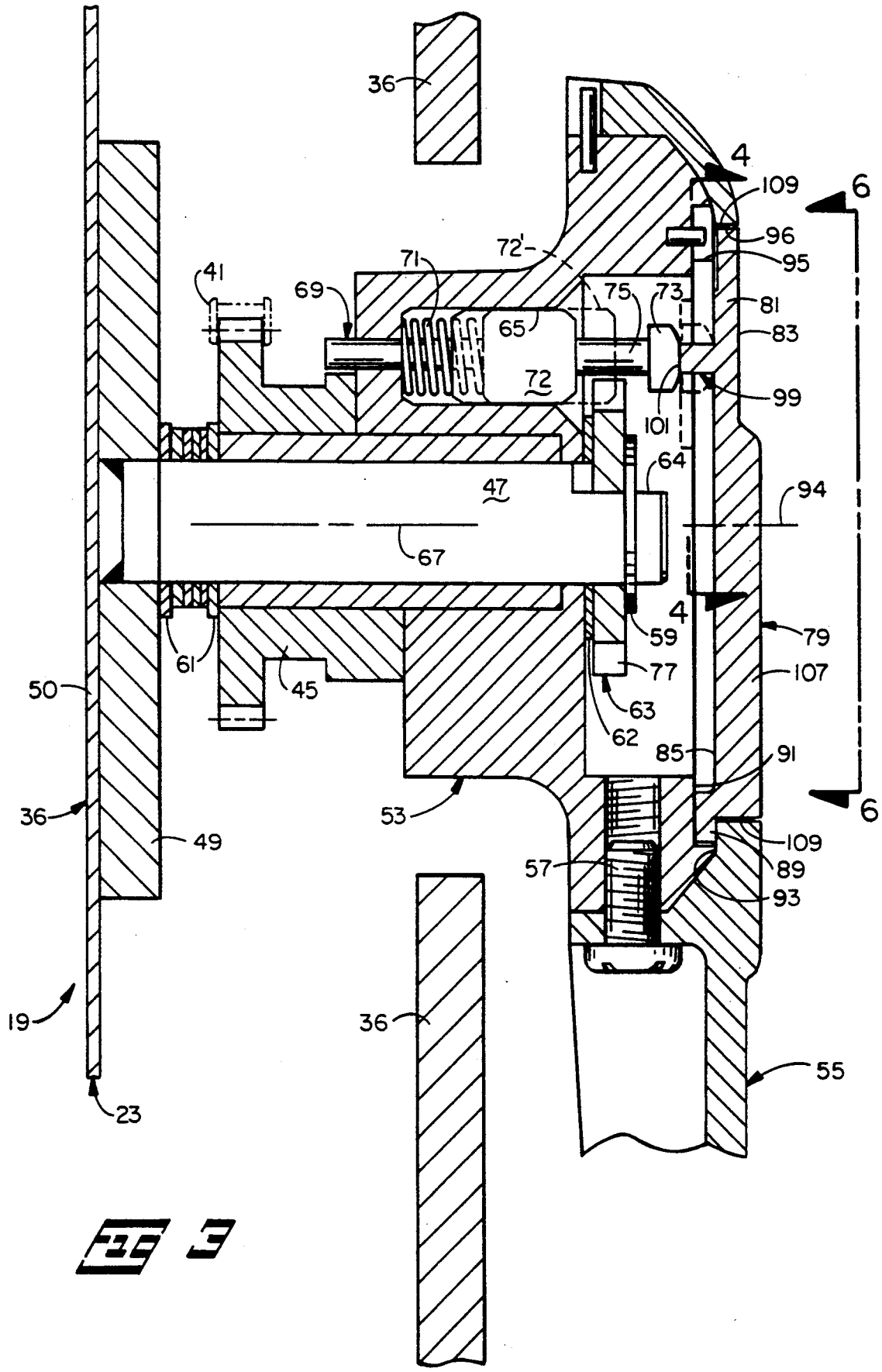
FIG. 3 is a longitudinal cross sectional view of the drive mechanism and carriage lock for the mobile storage system.

For purposes of background, a mobile storage system with which the apparatus and method of the present invention are used will be briefly described. Referring to FIGS. 2 and 3, reference numeral 19 indicates a typical mobile storage system,that is capable of storing large quantities of books, supplies, and other items in a small space. The mobile storage system 1 is comprised of a number of parallel rails 21 embedded in a building floor. Two or more long mobile carriages, such as mobile carriage 23, extend transversely across the rails 21. Wheels 25 and axles 27 rollingly support the carriage 23 for movement along the rails 21 in the directions of arrow 28.

To easily move the mobile carriages 23 along the rails 21, each mobile carriage is equipped with a manual drive system 29. In the particular construction shown, the drive system 29 comprises a chain and sprocket mechanism 31 that includes a first sprocket 33 on a selected axle 27, an intermediate sprocket 35 on an intermediate shaft 37, and a first chain 39 trained over the sprockets 33 and 35. The intermediate shaft 37 is supported in the mobile carriage frame 36 by known bearings 40. A second chain 41 is trained over a driven sprocket 43 on the intermediate shaft 37 and over a driver sprocket 45 that is rotatably mounted on a shaft 47. The shaft 47 is fixed to the carriage frame 36, as by a plate 49 fastened to a carriage panel 50 by studs 52 and nuts 54. Preferably, the shaft 47 is about waist height of a person using the mobile storage system 1.

Also rotatably mounted on the shaft 47 is a hub 53. Transverse flats, not shown, on the hub 53 and driver sprocket 45 enable the driver sprocket to rotate in response to rotation of the hub. To rotate the hub with ease, a handwheel 55, to be described in detail hereinafter, is fastened to the hub, as by radially extending screws 57. A retainer ring 59 on the end of the shaft retains the driver sprocket and hub, as well as some washers 61, 62 and a lock plate 63, on the shaft. The lock plate 63 is held against rotation on the shaft by means of a flat 64 on the shaft and a matching D-shaped bore in the lock plate.

Slidingly received in a hub bore 65 at a predetermined radial distance from the longitudinal axis 67 of the shaft 47 is a hardened pin 69. The pin 69 is biased out of the hub bore 65, that is, to the right in FIG. 3, by a spring 71. The pin is formed with a body 72, a head 73, and a relatively small diameter neck 75 between the pin body and head. The pin is slidable between a first position whereat the pin neck 75 is radially aligned with and out of contact with teeth 77 on the periphery of the stationary lock plate 63, and a second position whereat the pin body 72 is radially aligned with and in engagement with the lock plate teeth 77 and the pin neck 75 is axially displaced from the lock plate teeth. When the pin is in the first position thereof such that the pin body is not engaged with the lock plate, the hub 53, handwheel 55, and driver sprocket 45 are free to rotate on the shaft 47 and thus enable movement of the mobile carriage 23 along the rails 21. On the other hand, when the pin body is in the second position thereof, as indicated by phantom lines 72, in FIG. 3, rotation of the hub, and thus of the handwheel and driver sprocket, is prevented, and the mobile carriage 23 is locked against movement along the rails 21.

Figure 1:
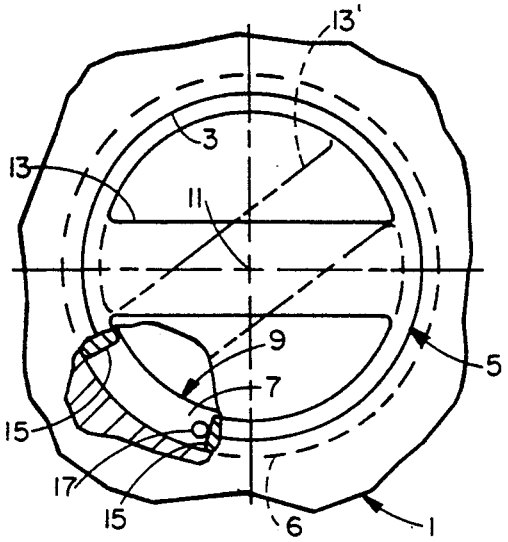
FIG 1 PRIOR ART
FIG. 1 is a partially broken front view of the locking knob of a prior mobile carriage lock.
Figure 4:
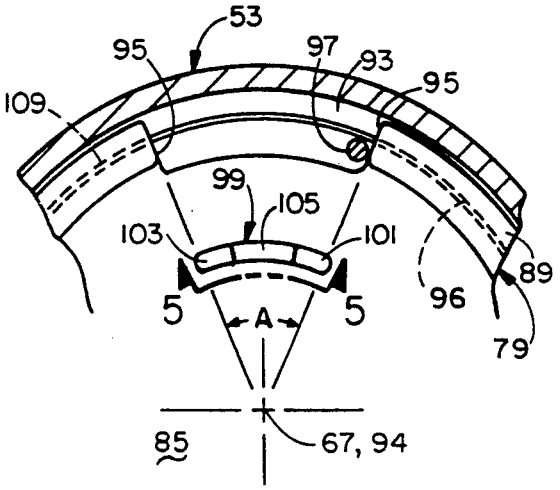
FIG. 4 is an enlarged partial cross sectional view taken along lines 4—4 of FIG. 3.

In accordance with the present invention, the pin 69 is slid between the first and second positions thereof by rotation of a locking knob 79 that provides a clear visual indication of the position of the pin 69 within the hub 53. The locking knob 79 is manufactured with a circular disk 81 having opposed first and second faces 83 and 85, respectively. The disk 81 has an outer periphery 109. The locking knob outer periphery 109 fits within a bore 96 in the handwheel. There is a small amount of radial clearance between the locking knob outer periphery and the surface of the handwheel bore 96. The locking knob includes an annular leg 89. The annular leg 89, and thus the locking knob, is loosely captured between a shallow counterbore 91 in the hub 53 and a back face 93 on the handwheel 55 such that the longitudinal axis 94 of the locking knob is concentric with the longitudinal axis 67 of the shaft 47. The locking knob is rotatable relative to the hub and handwheel through an angle of approximately 35 degrees. The angle of relative rotation is governed by a cutout 95 in the locking knob annular leg 89. Also see FIG. 4. The cutout 95 subtends an angle A of approximately 44 degrees about the locking knob longitudinal axis 94. A roll pin 97 pressed into the hub counterbore 91 projects into the locking knob cutout and serves to limit rotation of the locking knob relative to the hub and handwheel to first and second angularly spaced end positions approximately 35 degrees apart.

Figure 5:
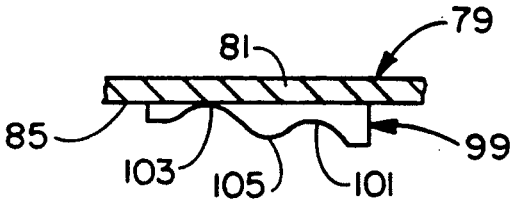
FIG. 5 is a cross sectional view taken along lines 5—5 of FIG. 4.

To slide the pin 69 within the hub bore 65 in response to rotation of the locking knob 79, a cam 99 is formed on the locking knob disk face 85. The cam 99 is generally arcuate in shape and subtends approximately the angle A about the locking knob longitudinal axis 94. Although shown in FIG. 4 as being radially aligned with the cutout 95, the cam 99 need not be so aligned. The cam has two angularly spaced depressions 101 and 103 on the opposite ends thereof and a ramp surface 105 that extends between the two depressions. As best shown in FIG. 5, the depressions 101 and 103 are displaced from each other in the directions of the locking knob longitudinal axis 94. The cam depressions 101 and 103 and the ramp surface 105 are designed to contact the head 73 of the pin 69. Accordingly, rotation of the locking knob about the longitudinal axis 67, 94 between the first and second end positions thereof relative to the hub 53 and handwheel 55 causes the pin to slide within the hub bore 65 between the pin first and second positions, respectively.

Figure 6:
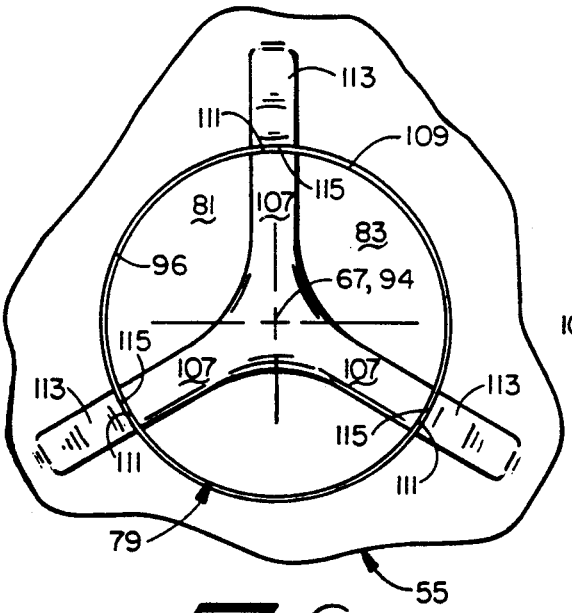
FIG. 6 is a view taken along lines 6—6 of FIG. 3 showing the carriage lock in the unlocked configuration.
Figure 7:
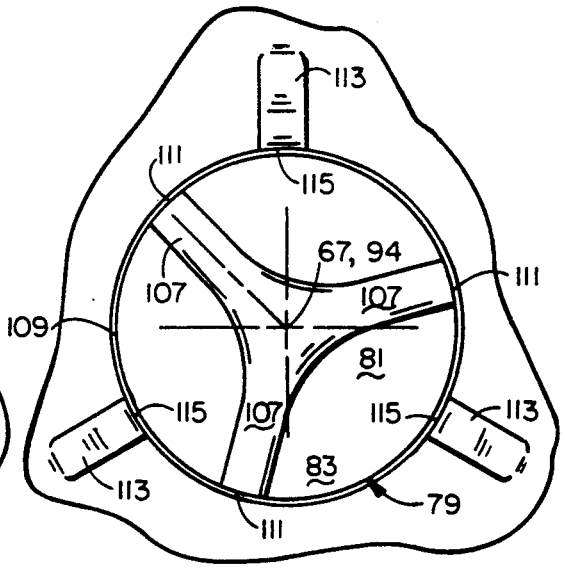
FIG. 7 is a view similar to FIG. 6, but showing the carriage lock in the locked configuration.

Looking also at FIGS. 6 and 7, the first face 83 of the locking knob disk 81 is fabricated with at least one and preferably three ridges 107. The ridges 107 radiate from the common longitudinal axis 67, 94 to the outer periphery 109 of the locking knob flange 87. Accordingly, the outer surfaces 101 of the ridges 107 are coplanar with the outer periphery 109 of the locking knob disk 81.

The handwheel 55 is also manufactured with ridges begin at respective inner surfaces 115 that are coplanar with the handwheel bore 96. The handwheel ridges 113 preferably have the same width and height as the locking knob ridges 107.

The locking knob 79 and handwheel 55 are designed such that the locking knob ridges 107 are radially aligned with associated handwheel ridges 113 when the locking knob is in the first end position thereof, as is shown in FIG. 6. With the locking knob in the first end position thereof, the head 73 of the pin 69 is aligned with and is received in the cam depression 101. As a consequence, the pin is in the first position thereof, and the hub 53 and handwheel 55 are free to rotate on the shaft 47.

By manually grasping the locking knob ridges 107 and rotating the locking knob counterclockwise with respect to FIG. 6 to its second end position as shown in FIG. 7, the locking knob cam 99 also rotates such that the head 73 of the pin 69 becomes aligned with and is received in the second cam depression 103. The spring 71 assures that the pin head slides along the cam ramp 105 to the cam depression 103. As a result, the pin 69 slides in the hub bore 65 to its second position, whereat the pin body 72 is radially aligned with and engages the teeth 77 of the lock plate 63. In that situation, the hub 53 and handwheel 55 are prevented from rotating on the shaft 47. Consequently, the mobile carriage 23 is locked against movement along the rails. Radial misalignment of the ridges 107 on the locking knob 79 and the ridges 113 on the handwheel 55 provides an immediate visual indication of the locked status of the mobile carriage. A person is thus clearly notified that she cannot rotate the handwheel to move the mobile carriage 23 until she unlocks it by rotating the locking knob clockwise back to the unlocked position of FIG. 6.

Further in accordance with the present invention, the visual indication of the locked status of the carriage lock given by the non-alignment of the locking knob ridges 107 and the handwheel ridges 113 in FIG. 7 is enhanced by providing a coating of a bright colored material on the respective ridge end surfaces 111 and 115. When the locking knob 79 is in the unlocked position of FIG. 6, the end surfaces 111 and 115 of the aligned ridges are very close to each other. Accordingly, the bright colored ridge end surfaces are hidden from the user's view. With nothing to prompt the user from turning the handwheel 55, she does so and moves the mobile carriage without problem. On the other hand, we have found that the layer of bright colored material on the end surfaces of the misaligned ridges of FIG. 7 is very quickly noticed by a person approaching the mobile carriage to turn the handwheel 55. The user thus has a second clear visual indication that she must restore the locking knob 9 to its unlocked position of FIG. 6 before she can turn the handwheel and move the carriage.

Thus, it is apparent that there has been provided, in accordance with the invention, a carriage lock visual indicator that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A mobile storage system comprising:

a. a plurality of rails embedded in a building floor;

b. at least one mobile carriage that spans the rails;

c. wheel means for rollingly supporting the mobile carriage on the rails;

d. drive means mounted to the mobile carriage and connected to the wheel means for moving the mobile carriage along the rails in response to manual actuation of the drive means, wherein the drive means comprises:

i. a shaft fixed to the mobile carriage and having a longitudinal axis;

ii. handwheel means for rotating on the shaft; and iii. chain and sprocket means connected between the wheel means and the handwheel means for transferring rotation of the handwheel means to the wheel means to move the mobile carriage along the rails in response to rotation of the handwheel means;

e. lock means received within the drive means for being selectively operable to a locked status whereat the drive means is locked against rotation to thereby prevent moving the mobile carriage along the rails and to an unlocked status whereat the drive means is unlocked for rotation to thereby enable moving the mobile carriage, wherein the lock means comprises:

i. a lock plate held stationarily to the shaft;

ii. pin means for sliding within the handwheel means between a first position whereat the pin means is disengaged from the lock plate to enable rotation of the handwheel means and a second position whereat the pin means is in engagement with the lock plate to prevent rotation of the handwheel means; and iii. knob means rotatably received within the handwheel means for sliding the pin means between the first and second positions thereof in response to rotation of the knob means between first and second angularly spaced end positions, respectively; and f. indicator means in operative association with the drive means and the lock means for providing visual information regarding the locked or unlocked status of the lock means, wherein the indicator means comprises:

i. at least one ridge on the handwheel means; and ii. at least one ridge on the knob means, the ridge on the knob means being in alignment with the ridge on the handwheel means when the knob means is in a selected one of the first and second end position thereof and the ridge on the knob means being misaligned with the ridge on the handwheel means when the knob means is in the other of the selected first and second end positions thereof relative to the handwheel means.

2. The mobile storage system of claim 1 wherein:

a. the ridge of the knob means radiates from the shaft longitudinal axis; and b. the ridge on the handwheel means radiates from the shaft longitudinal axis, so that the ridges on the knob means and on the handwheel means are radially aligned when the knob means is in the selected one of the end position thereof and the ridges on the knob means and handwheel means are radially misaligned when the knob means is in the other of the selected end position thereof.

3. The mobile storage system of claim 2 wherein:

a. the knob means comprises a disk having a longitudinal axis concentric with the shaft longitudinal axis and an outer periphery;

b. the ridge on the knob means is formed on the knob means disk and has an end surface that is coplanar with the disk outer periphery;

c. the handwheel means comprises a handwheel having a bore that is concentric with the knob means disk longitudinal axis and that receives the knob means disk, the handwheel bore being spaced a short distance radially from the knob means disk outer periphery; and d. the ridge on the handwheel means is formed on the handwheel and has an end surface that is coplanar with the handwheel bore, so that the end surfaces of the ridges on the knob means and on the handwheel are closely spaced to each other and are radially aligned when the knob means is in the selected one of the end positions thereof, and the end surfaces of the ridges on the knob means and on the handwheel are separated from each other and are radially misaligned when the knob means is in the other of the end positions thereof.

4. The mobile storage system of claim 3 wherein the end surface of at least one of the ridges on the knob means and on the handwheel is coated with a bright material that provides enhanced visual indication of radial misalignment of the ridges on the knob means and on the handwheel when the knob means is in the other of the selected end positions thereof.

5. A mobile storage system comprising:

a. a plurality of rails embedded in a building floor;

b. at least one mobile carriage that spans that rails;

c. wheel means for rollingly supporting the mobile carriage on the rails;

d. drive means mounted to the mobile carriage and connected to the wheel means for moving the mobile carriage along the rails in response to manual actuation of the drive means;

e. lock means received within the drive means for being selectively operable to a locked status whereat the drive means is locked against rotation to thereby prevent moving the mobile carriage along the rails and to an unlocked status whereat the drive means is unlocked for rotation to thereby enable moving the mobile carriage; and f. indicator means in operative association with the drive means and the lock means for providing visual information regarding the locked or unlocked status of the lock means, wherein the indicator means comprises:

i. at least one first generally rectangular raised ridge on the drive means; and ii. at least one second generally rectangular raised ridge on the lock means, the first and second raised ridges being aligned in end-to-end relation when the lock means is operated to the unlocked status thereof to enable rotation of the drive means, the first and second raised ridges being misaligned end-to-end when the lock means is operated to the locked status thereof.

6. The mobile storage system of claim 5 wherein:

a. the first and second raised ridges have respective end surfaces that are generally parallel and closely spaced to each other when the raised ridges are aligned in end-to-end relation and that are remote from each other when the raised ridges are misaligned end-to-end; and b. the end surface of at least one of the first and second raised ridges is coated with a bright material, so that the bright ridge end surface provides an enhanced visual indication of whether the lock means is selected to the locked or unlocked status thereof.

7. In a mobile carriage having a frame; wheel means for rollingly supporting the mobile carriage on rails embedded in a building floor; drive means for rotating the wheel means to roll the mobile carriage along the rails, wherein the drive means comprises a handwheel having a bore with a longitudinal axis, the handwheel being rotatable about the bore longitudinal axis; and lock means for selectively unlocking and locking the drive means to enable and prevent, respectively, rotation of the drive means, a visual indicator that informs a user of the unlocked or locked status of the lock means comprising:

a. a locking knob captured in the drive means and rotatable within the handwheel bore about the handwheel bore longitudinal axis and having a first face with cam means for contacting the lock means and a second face that defines at least one first ridge thereon visible to the user, the first ridge radiating from the handwheel longitudinal axis, the locking knob being selectively rotatable relative to the drive means between a first end position whereat the locking knob cam means causes the lock means to disengage from the drive means and thereby unlock the lock means to enable rotation of the drive means and a second end position whereat the locking knob cam means causes the lock means to engage the drive means and thereby lock the lock means to prevent rotation of the drive means; and b. at least one second ridge formed on the handwheel and radiating from the handwheel longitudinal axis for aligning with the first ridge when the locking knob is rotated to a selected one of the first and second end positions thereof and for misaligning with the first ridge when the locking knob is rotated to the other of the end positions thereof, so that the first and second ridges are radially aligned with each other when the locking knob is rotated relative to the handwheel to the selected one of the first and second end position thereof and the first and second ridges are radially misaligned with each other when the locking knob is rotated to the other of the first and second end positions thereof, and the user can determine whether the lock means is in the unlocked status or in the locked status by looking at the alignment or misalignment of the first and second ridges.

8. The visual indicator of claim 7 wherein the first and second ridges are radially aligned when the locking knob is rotated to the first end position thereof relative to the handwheel.

9. The visual indicator of claim 8 wherein:

a. the first ridge has an outer surface at a first radial distance from the handwheel longitudinal axis, and the second ridge has an inner surface at a second radial distance from the handwheel longitudinal axis slightly spaced from the first ridge outer surface when the first and second ridges are radially aligned with each other; and b. at least one of the second ridge inner surface and the first ridge outer surface is coated with a bright material, so that the coated ridge surface is readily visible to the user when the locking knob is rotated relative to the handwheel to the end position thereof whereat the first and second ridges are radially misaligned.

10. Apparatus for locking a handwheel against rotation about a fixed shaft having a longitudinal axis comprising:

a. a lock plate stationarily held to the shaft;

b. hub means fastened to the handwheel for rotation therewith on the shaft;

c. pin means received within the hub means for sliding therein;

d. a locking knob captured between the hub means and the handwheel and being rotatable relative thereto about the shaft longitudinal axis, the locking knob having cam means for sliding the pin means between a first position whereat the pin means is disengaged from the lock plate to enable rotation of the handwheel when the locking knob is rotated to a first end position thereof relative to the handwheel and the hub means, and a second position whereat the pin means is engaged with the lock plate to thereby prevent rotation of the handwheel when the locking knob is rotated to a second end position relative to the handwheel and the hub means, the locking knob having at least one elongated ridge thereon; and e. at least one ridge formed on the handwheel, the handwheel ridge and the locking knob ridge being aligned with each other when the locking knob is rotated to a selected one of the first and second end positions thereof relative to the handwheel and hub means, and the handwheel ridge and the locking knob ridge being misaligned when the locking knob is rotated to the other of the end positions thereof.

11. Apparatus for locking a handwheel against rotation about a fixed shaft having a longitudinal axis comprising:

a. a lock plate stationarily held to the shaft;

b. hub means fastened to the handwheel for rotation therewith on the shaft;

c. pin means received within the hub means for sliding therein;

d. a locking knob captured between the hub means and the handwheel and being rotatable relative thereto about the shaft longitudinal axis, the locking knob having cam means for sliding the pin means between a first position whereat the pin means is disengaged from the lock plate to enable rotation of the handwheel when the locking know is rotated to a first end position thereof relative to the handwheel and the hub means, and a second position whereat the pin means is engaged with the lock plate to thereby prevent rotation of the handwheel when the locking knob is rotated to a second end position relative to the handwheel and the hub means, the locking knob having at least one elongated ridge thereon, wherein the locking knob ridge radiates from the shaft longitudinal axis and terminates in an outer surface located at a first predetermined distance from the shaft longitudinal axis; and e. at least one ridge formed on the handwheel, the handwheel ridge and the locking knob ridge being aligned with each other when the locking knob is rotated to a selected one of the first and second end positions thereof relative to the handwheel and hub means, and the handwheel ridge and the locking knob ridge being misaligned when the locking knob is rotated to the other of the end positions thereof, wherein the handwheel ridge radiates from the shaft longitudinal axis and terminates in an inner surface located at a second predetermined distance slightly greater than the firs predetermined distance from the shaft longitudinal axis, the handwheel ridge inner surface and the locking knob ridge outer surface being in close proximity to each other when the locking knob ridge and handwheel ridge are aligned with each other.

12. The apparatus of claim 11 wherein at least one of the inner surface of the handwheel ridge and the outer surface of the locking knob ridge is coated with a bright colored material, so that the coated surface is readily visible to a person when the locking knob is rotated to the end position thereof whereat the locking knob and handwheel ridges are misaligned.

13. The apparatus of claim 12 wherein the handwheel ridge and locking knob ridge are misaligned when the locking knob is in the second end position thereof relative to the handwheel and hub means.

14. A method of visually indicating the locked or unlocked status of a mobile carriage comprising the steps of:

a. mounting a hub and handwheel for rotation on the mobile carriage about a shaft longitudinal axis;

b. providing a first ridge on the handwheel;

c. providing a drive mechanism for moving the mobile carriage in response to rotation of the handwheel;

d. capturing a locking knob having a second ridge thereon between the hub and the handwheel;

e. providing a pin slidable within the hub between a first position whereat the pin is disengaged from the shaft to enable rotation of the hub and handwheel on the shaft in an unlocked status of the mobile carriage, and a second position whereat the pin is engaged with the shaft to prevent the handwheel and hub rotation on the shaft in a locked status of the mobile carriage; and f. rotating the locking knob relative to the handwheel and hub to a first end position whereat the second ridge is aligned with the first ridge and simultaneously sliding the pin to a selected one of the first and second positions thereof, so that alignment or misalignment of the first and second ridges provides a visual indication of a user of the locked or unlocked status of the mobile carriage.

15. The method of claim 14 comprising the further step of rotating the locking knob relative to the hub and handwheel to a second end position whereat the first and second ridges are misaligned with each other and simultaneously sliding the pin to the other of the first and second position thereof.

16. The method of claim 15 comprising:

the first steps of locating an outer surface on the second ridge proximate an inner surface of the first ridge when the locking knob is rotated to the first end position thereof relative to the hub and handwheel, and locating the second ridge outer surface remote from the first ridge inner surface when the locking knob is rotated to the second end position thereof relative to the hub and handwheel.

17. The method of claim 16 comprising the further step of coating a selected one of the first ridge inner surface and the second ridge outer surface with a bright color, so that the bright colored surface on the selected one of the first ridge inner surface and the second ridge outer surface is hidden form view when the locking knob is rotated to the first end position thereof relative to the handwheel and hub and the bright surface is exposed to view when the locking knob is rotated to the second end position thereof relative to the handwheel and hub.

18. The method of claim 17 wherein the step of rotating the locking knob to the second end position thereof relative to the handwheel and hub to expose to view the bright surface on the selected one of the first ridge inner surface and the second ridge outer surface comprises the step of simultaneously sliding the pin to the second position thereof to thereby prevent rotation of the handwheel and hub and place the mobile carriage in the locked status thereof, so that the bright surface gives a visual indication of the locked status of the mobile carriage.

19. The method of claim 14 comprising the further step of radially aligning the firs ridge on the handwheel wit the second ridge on the locking knob when the locking knob is in the first end position thereof relative to the hub and handwheel.

* * * * *